US007387201B2

(12) United States Patent
Olsen et al.

(10) Patent No.: US 7,387,201 B2
(45) Date of Patent: Jun. 17, 2008

(54) CONTAINER CARRIER HAVING LONGITUDINAL END LOOP

(75) Inventors: Robert Olsen, Medinah, IL (US); R. Gary Privett, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 89 days.

(21) Appl. No.: 11/114,368

(22) Filed: Apr. 26, 2005

(65) Prior Publication Data

US 2006/0243606 A1 Nov. 2, 2006

(51) Int. Cl.
*B65D 75/00* (2006.01)
*B66C 1/10* (2006.01)

(52) U.S. Cl. ..... 206/150; 206/161; 206/162; 294/87.2

(58) Field of Classification Search ..... 206/141–143, 206/145–151, 162, 192, 427, 161; 294/87.2
See application file for complete search history.

(56) References Cited

U.S. PATENT DOCUMENTS 3,700,275 A * 10/1972 Deasy ..... 294/87.2
5,425,446 A * 6/1995 Weaver et al. ..... 206/145
5,642,808 A 7/1997 Marco et al.
5,657,863 A * 8/1997 Olsen ..... 206/150
5,746,310 A * 5/1998 Slomski ..... 206/150
5,806,667 A 9/1998 Marco
6,415,917 B1 * 7/2002 Marco ..... 206/147
6,969,098 B2 * 11/2005 Olsen ..... 294/87.2
2005/0077194 A1 * 4/2005 Marco et al. ..... 206/162

* cited by examiner

*Primary Examiner*—Bryon P Gehman
(74) *Attorney, Agent, or Firm*—Pauley Petersen & Erickson

(57) ABSTRACT

A flexible carrier for carrying a plurality of containers includes a flexible sheet having two rows of container receiving apertures formed therein. The plurality of containers are each placed into a respective container receiving aperture and are thus unitized in a package. The flexible carrier further includes a loop extending between the two rows of container receiving apertures at a periphery of the flexible sheet on an end of the package and beyond a longitudinal edge of the rows of the unitized containers. The loop is preferably capable of supporting the package when grasped by a consumer. The flexible carrier may further include an upwardly extending handle and/or a panel integrated with respect to the flexible sheet. The resulting package may be grasped from an end with the loop or, alternatively, from the top with the handle.

13 Claims, 3 Drawing Sheets

CONTAINER CARRIER HAVING LONGITUDINAL END LOOP

BACKGROUND OF THE INVENTION

1. Field of the Invention

This invention relates to a flexible carrier for carrying a plurality of containers such as cans or bottles.

2. Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers may be used to unitize groups of four, six, eight, twelve or other suitable groups of containers into a convenient multipackage. Newer flexible ring carriers may include a handle that extend upwardly from the carrier to enable a consumer to carry the package. Difficulty may arise if a traditional carrier, particularly an elongated package of eight or twelve containers, is placed on a narrow shelf and/or in a refrigerator so that the top lift handle is not accessible, such as a display that results in accessibility of the package along only a two-wide side of the package.

SUMMARY OF THE INVENTION

The present invention is directed to a flexible carrier for packaging containers that includes an arrangement of container receiving apertures and at least one loop for grasping the carrier from a longitudinal end of the resulting package.

According to preferred embodiments of this invention, each flexible carrier preferably includes two rows of container receiving apertures, each for receiving a container, to form a package. A loop is preferably connected between the two rows of container receiving apertures and protrudes from at least one edge of the package. Preferably, the package according to this invention includes a pair of loops, each loop protruding from a respective opposite edge of the package.

In addition, a handle is preferably connected between the rows of container receiving apertures. A plurality of struts may connect the handle with the flexible sheet between the rows of container receiving apertures, preferably between a centerline of the flexible sheet and the handle.

The resulting package may include loops that extend outward from each longitudinal edge of the package and a handle that extends upwardly from between each row of container receiving apertures. As such, the package may be grasped from the top or from either longitudinal end. This is particularly helpful if the package is positioned on a narrow shelf, such as within a refrigerated cooler.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
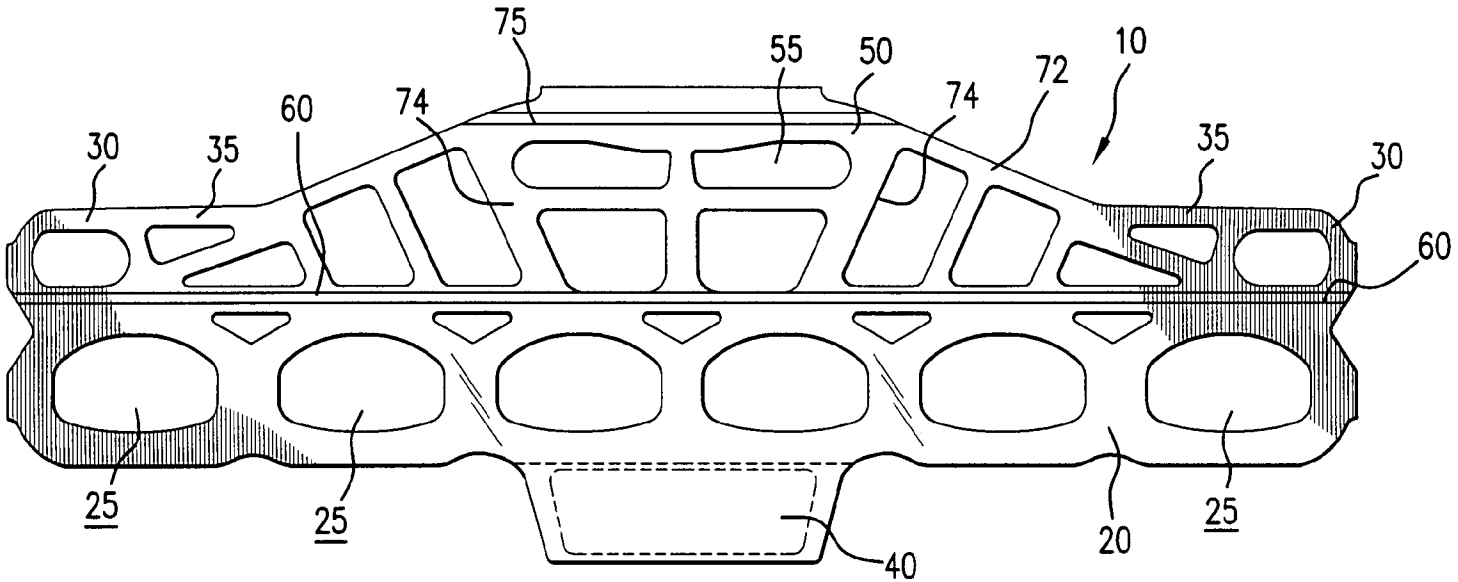
FIG. 1 is a side elevational view of a flexible carrier according to one preferred embodiment of this invention.
Figure 2:
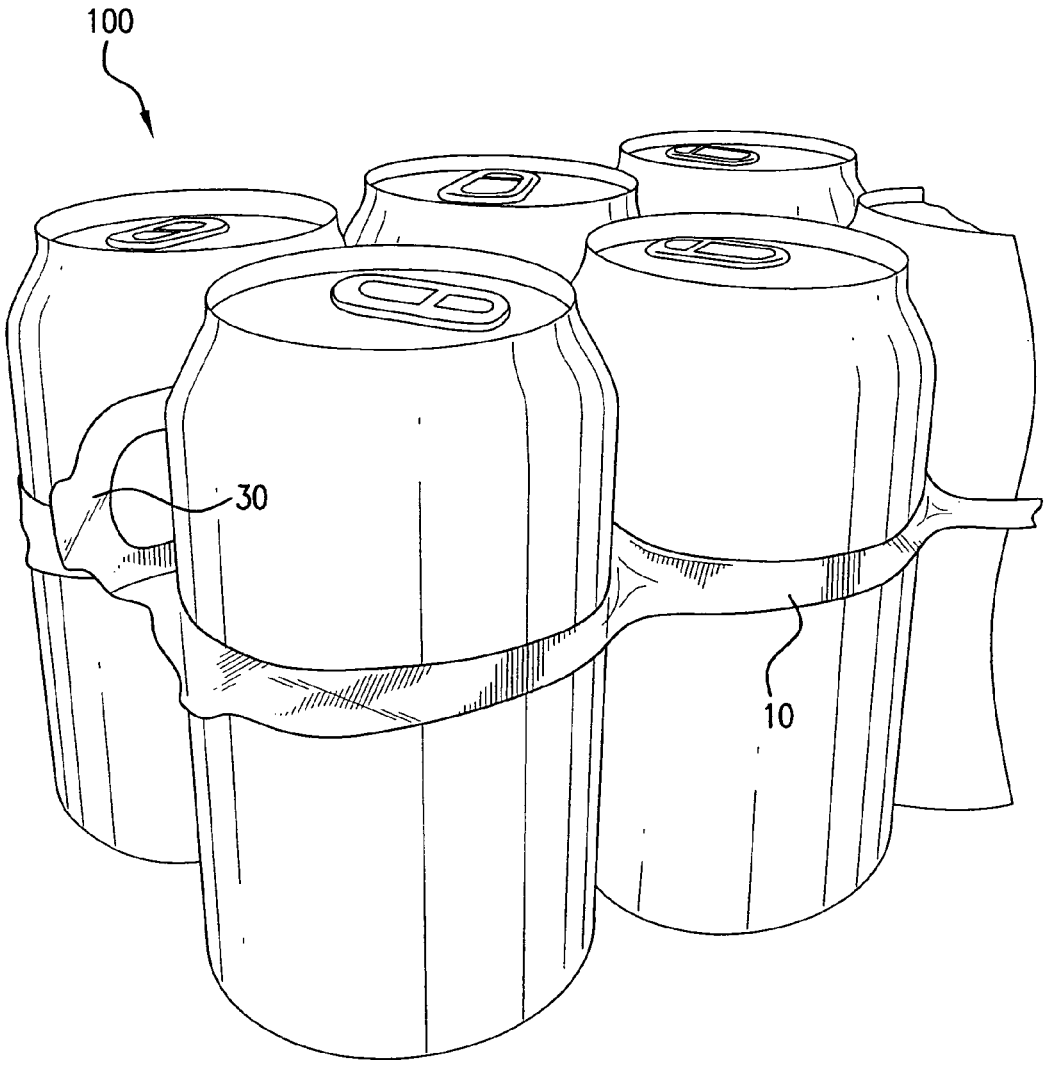
FIG. 2 is a front left perspective view of a package of containers according to one preferred embodiment of this invention.
Figure 3:
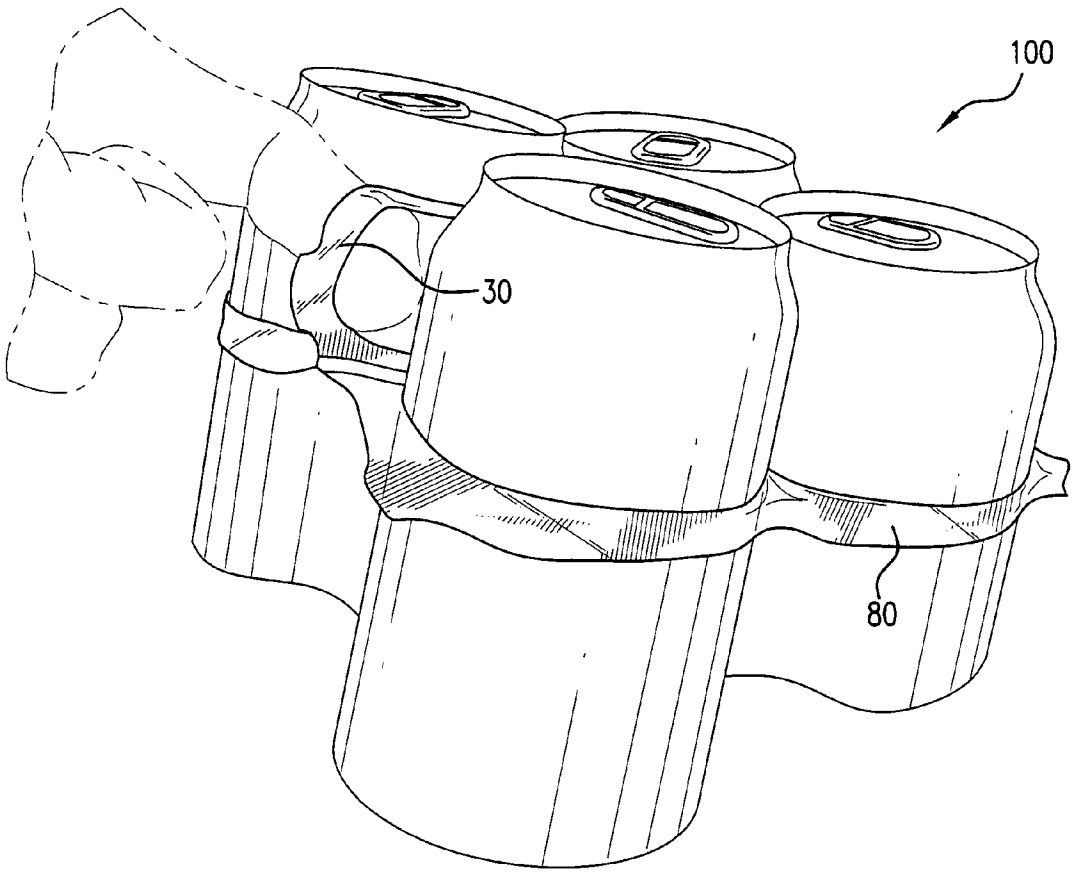
FIG. 3 is a front left perspective view of the package shown in FIG. 2 showing manual engagement of a loop at one end of the package.

FIG. 1 shows flexible carrier 10 for unitizing twelve containers to form a unitized package. FIGS. 2 and 3 show a package of unitized containers. Although FIGS. 1-3 illustrate various structures for flexible carrier 10 of the invention, the illustrations are exemplary, and the invention is not limited to the flexible carriers 10 or packages shown. For example, flexible carrier 10 may be configured and used to unitize four, six, eight or any other desired number of containers.

The containers, such as those shown in packages in FIGS. 2 and 3, are preferably cans. Although cans are shown in FIGS. 2 and 3, bottles or any other commonly unitized container may be used with flexible carrier 10 according to this invention. The containers are preferably, though not necessarily, like-sized within a single flexible carrier 10.

Each flexible carrier 10 preferably includes one or more layers of flexible sheet 20 having a width and length defining therein a plurality of container receiving apertures 25, each for receiving a container 80. The plurality of container receiving apertures 25 are preferably arranged in longitudinal rows and longitudinal ranks so as to form an array of container receiving apertures 25, such as two rows by three ranks for a six container multipackage; two rows by six ranks for a twelve container multipackage, etc. Container receiving apertures 25 are preferably elongated in a longitudinal direction of flexible carrier 10.

According to one preferred embodiment of this invention, such as shown in FIG. 1, two layers of flexible sheet 20 are connected along a longitudinally extending centerline 60. Centerline 60 as used herein generally describes a segment between rows of container receiving apertures 25 and/or between layers of flexible sheet 20. According to one preferred embodiment of this invention, centerline 60 comprises a weld that joins the two layers of flexible sheet 20. The two layers of flexible sheet 20 may be coextruded, welded, or otherwise joined together to create flexible carrier 10. "Weld" as used in the specification and claims may be defined as a hot weld, cold weld, lamination or any other manner of connection that joins two sheets of material known to those having ordinary skill in the art.

As shown in FIG. 1, a row of container receiving apertures 25 is preferably formed on each side of centerline 60 and/or in each layer of the two layers of flexible sheet 20. As such, one row of container receiving apertures 25 is preferably formed along each side of the centerline 60. Accordingly, twelve container receiving apertures 25 are formed in flexible carrier 10 shown in FIG. 1, i.e. two overlapping rows of six container receiving apertures 25 each. Container receiving apertures 25 are preferably formed in a geometry that results in a tight unitization of containers 80 without excess play and/or sliding between and among containers 80 and flexible carrier 10.

As best shown in FIGS. 1 and 3, loop 30 is preferably positioned relative to flexible sheet 20 so as to extend between the two rows of container receiving apertures 25 from a periphery of flexible sheet 20. Specifically, loop 30 may extend from centerline 60, which may comprise a weld or seam between adjacent layers of flexible sheet 20. Loop 30 may be integrally formed with flexible sheet 20 or may comprise a separately formed and affixed feature of flexible carrier 10.

Loop 30 preferably extends from an end of flexible carrier 10, and specifically from an end of package 100 and, preferably, one loop 30 extends from each end of package 100. Each loop 30 preferably extends beyond a longitudinal edge of the rows of container receiving apertures 25 and, following application of flexible carrier 10 to containers 80, beyond a longitudinal edge of containers 80 within package 100.

Loop 30 preferably forms a discrete ring within flexible carrier 10 and, as described in more detail below, is capable of supporting the weight of package 100 when grasped by a consumer. As a result of the configuration of loop 30 relative to flexible sheet 20, it should be apparent to a consumer that loop 30 is intended for grasping and lifting of package 100.

As shown in FIG. 1, according to one preferred embodiment of this invention, handle 50 is formed along the centerline 60 between the two rows of container receiving apertures 25 and in a separate plane from the two rows of container receiving apertures 25. Specifically, as shown in FIG. 1, handle 50 is connected along a side of the row of container receiving apertures 25, and is preferably connected with respect to centerline 60, such as a weld. Handle 50 may be integrally formed with flexible sheet 20 or may be separately formed and attached relative to flexible sheet 20.

Handle 50 may comprise one or more elongated apertures 55 positioned along the outer periphery of handle 50 or may comprise a similar configuration that provides an ample area for a consumer to grasp by inserting his hand through and still maintain the purpose and integrity of package 100.

As best shown in FIG. 1, a plurality of struts 70 connect handle 50 with the rows of container receiving apertures 25, preferably between centerline 60 and handle 50. In the two layer of flexible sheet 20 embodiment of the subject invention, struts 70 are preferably formed in both layers of flexible sheet 20 and one or more handle welds 75 may be positioned longitudinally across handle 50. The plurality of struts 70 may comprise inner struts 74 located across internal portions of flexible carrier 10 and outer struts 72 located across a periphery of flexible carrier 10.

According to one preferred embodiment of this invention, loop 30 may be connected directly to outer handle strut 72, such as through loop strut 35. Such a configuration assists in maintaining a position of loop 30 at an outer edge of flexible carrier 10 and generally away from handle 50 and further provides strength and support when the weight of package 100 is supported by loop 30.

As best shown in FIG. 1, according to one preferred embodiment of this invention, panel 40 is preferably formed along a side of the row of container receiving apertures 25 opposite handle 50. Panel 40 preferably accommodates, on one or both sides, UPC and proof of purchase labels, graphics, and promotional and/or other information related to contents and/or ingredients of containers 80 and/or package 100.

As shown in FIGS. 2 and 3, package 100 resulting from flexible carrier 10 includes a plurality of unitized containers 80. Flexible carriers 10 are generally applied to containers 80 by stretching flexible sheet 20 surrounding container receiving apertures 25 around the perimeter of container 80, and allowing the stretched carrier 10 to recover, thereby providing a tight engagement. Carrier 10 is typically applied to a chime or rib or container 80, where this structure exists, or to a main sidewall.

As a result of the described configuration in one preferred embodiment of this invention, two layers of flexible sheet 20 joined with the longitudinally extending centerline 60 include a row of container receiving apertures 25 formed in each layer of the two layers of flexible sheet 20. One row of container receiving apertures 25 is formed on each side of centerline 60 resulting in flexible carrier 10 fanning out at centerline 60 to permit a generally flat plane of engagement within which containers 80 are inserted. Handle 50 and loop 30 preferably each extend in a different plane from flexible sheet 20 in this configuration. In this manner, each row of container receiving apertures 25 engages a respective row of containers 80 to form package 100.

According to a preferred embodiment of this invention, package 100 includes three areas from which package 100 may be grasped and carried. A pair of loops 30 suitable for manual grasping are preferably positioned one at each end of package 100, such as shown in FIG. 3, wherein when the plurality of containers 80 are disposed within container receiving apertures 25, loop 30 extends outward from a longitudinal edge of package 100.

Handle 50 suitable for manual grasping preferably extends from an approximate middle of flexible sheet 20. In package 100 according to one preferred embodiment of this invention, handle 50 preferably extends upwardly from centerline 60 and between each row of container receiving apertures 25. Handle struts 70 permit proper separation between centerline 60 and handle 50 to permit a comfortable grasping area within package 100.

As such, package 100 may be carried by manually grasping from at least one of handle 50 extending upwardly from package 100 or from either of the pair of loops 30 extending outwardly from each longitudinal end of package 100. A preferred manner of grasping and carrying may be dependent upon how package 100 is presented at a point of purchase to the consumer. For instance, in a narrow shelf or refrigerated cooler, package 100 may be presented along a two-wide side or edge of package 100 thereby encouraging use of loop 30. Alternatively, package 100 may be stacked in an endcap or otherwise displayed to present a top of package 100 thereby encouraging use of handle 50.

While in the foregoing specification this invention has been described in relation to certain preferred embodiments thereof, and many details have been set forth for purpose of illustration, it will be apparent to those skilled in the art that flexible carrier 10 and package 100 are susceptible to additional embodiments and that certain of the details described herein can be varied considerably without departing from the basic principles of the invention.

The invention claimed is:

1. A package including a plurality of containers unitized within a flexible carrier, the package comprising:

one or more layers of flexible sheet;

two rows of container receiving apertures formed in the flexible sheet, each row of container receiving apertures engaging a respective row of containers;

a handle extending upwardly from between the rows of container receiving apertures;

a plurality of handle struts connecting the handle with respect to the flexible sheet, including an outer handle strut of the plurality of handle struts; and a loop connected with respect to the outer handle strut and extending between the two rows of container receiving apertures from a periphery of the flexible sheet at an end of the package, the loop extending beyond a free edge at a longitudinal end of the rows of containers, the handle and the loop being independently capable of supporting the package when grasped by a consumer.

2. The package of claim 1 wherein a loop extends from each end of the package.

3. The package of claim 1 further comprising:

a seam extending between the two rows of container receiving apertures.

4. The package of claim 3 wherein the loop extends from the seam.

5. The package of claim wherein the loop comprises a discrete ring extending from the end of the package.

6. The package of claim 1 further comprising:

a panel extending downwardly from at least one row of container receiving apertures.

7. The package of claim 1 further comprising:

a centerline dividing the rows of container receiving apertures;

a handle extending upwardly from the centerline, wherein the loop extends upwardly from the centerline and away from the handle.

8. A flexible carrier for carrying a plurality of containers formed of at least one layer of flexible sheet, the flexible carrier comprising:

an array of container receiving apertures formed in the flexible sheet and arranged in longitudinal rows and transverse ranks;

a handle formed between the longitudinal rows of container receiving apertures; and a plurality of handle struts connecting the handle with the longitudinal rows of container receiving apertures in the flexible sheet;

a loop and a loop strut wherein the loop strut connects the loop with respect to the handle; and the loop formed between the longitudinal rows of container receiving apertures at a periphery of the flexible sheet and extending beyond a free edge at a longitudinal end of the rows of container receiving apertures, wherein the handle and the loop are independently capable of supporting the flexible carrier and the plurality of containers.

9. The flexible carrier of claim 8 further comprising:

two layers of flexible sheet wherein a row of container receiving apertures is formed in each layer of the two layers of flexible sheet; and a centerline formed between the rows of container receiving apertures.

10. The flexible carrier of claim 9 wherein the centerline comprises a weld.

11. A flexible carrier for carrying a plurality of containers, said carrier comprising:

a flexible sheet having a plurality of container receiving apertures formed therein;

a handle suitable for manual grasping extending from an approximate middle of the flexible sheet;

a plurality of handle struts connecting the handle with respect to the flexible sheet, including a pair of outer handle struts of the plurality of handle struts;

a pair of loops connected with respect to the pair of outer handle struts and suitable for manual grasping, each loop of the pair extends outwardly, beyond a respective longitudinal end of the flexible sheet and being independently capable of supporting the carrier carrying the plurality of containers;

wherein when the plurality of containers are disposed within the container receiving apertures, the carrier and containers may be manually grasped and supported by any one of the handle and each loop.

12. The flexible carrier of claim 11 further comprising:

two layers of flexible sheet each layer forming a row of container receiving apertures.

13. The flexible carrier of claim 12 further comprising a centerline joining the two layers of flexible sheet between two rows of container receiving apertures.

* * * * *